United States Patent [19]

Reed

[11] Patent Number: 4,844,537

[45] Date of Patent: Jul. 4, 1989

[54] DUAL PURPOSE HIGH CHAIR AND HOOK-ON BABY SEAT

[76] Inventor: Peggy H. Reed, 552 S. Solomon, Mesa, Ariz. 85204

[21] Appl. No.: 211,832

[22] Filed: Jun. 27, 1988

[51] Int. Cl.[4] ..... A47B 39/00

[52] U.S. Cl. ..... 297/174; 297/134

[58] Field of Search ..... 297/174, 130, 134, 148, 297/152

[56] References Cited

U.S. PATENT DOCUMENTS

| | | | |
|---|---|---|---|
| 3,253,860 | 5/1966 | Shapiro | 297/134 X |
| 3,425,743 | 2/1969 | Peterson | 297/19 |
| 3,649,074 | 3/1972 | McDonald et al. | 297/153 |
| 4,568,120 | 2/1986 | Hoffman | 297/174 |
| 4,664,396 | 5/1987 | Pietrafesa | 297/134 X |

FOREIGN PATENT DOCUMENTS

| | | | |
|---|---|---|---|
| 1052650 | 3/1959 | Fed. Rep. of Germany | 297/174 |
| 978691 | 4/1951 | France | 297/130 |
| 2367455 | 6/1978 | France | 297/134 |

*Primary Examiner*—Kenneth J. Dorner
*Assistant Examiner*—Laurie K. Cranmer
*Attorney, Agent, or Firm*—Warren F. B. Lindsley

[57] ABSTRACT

A high chair comprising a seat component, a tray and a supporting leg structure with the leg structure being detachably connected to the seat component. The seat component comprises a hook-on type baby seat with a forwardly projecting anchor member which anchor member is telescopically and detachably connected to the tray when the high chair is used and when the tray is detached therefrom the anchor member is adapted to overlie a table. A pair of gripping members are mounted below the anchor member for gripping a bottom surface of the table with a latch extending between the gripping member and the anchor member for latching the gripping members in position.

6 Claims, 2 Drawing Sheets

DUAL PURPOSE HIGH CHAIR AND HOOK-ON BABY SEAT

BACKGROUND OF THE INVENTION

This invention relates to foldable high chairs and more particularly, to high chairs, the detachable seat portion of which may be adaptable to overlie a table with gripping members forming a supporting portion of a tray structure gripping bottom and top surfaces of the table. A latch extending between the gripping members and the back of the baby seat latch the gripping members and tray in position on the edge of the table.

The infant high chair came into use as a child rearing aid and is intended to introduce young children into the social activities of the family meal.

As families became more mobile, the need for the child's comfort and the convenience in caring for it became more important. The infant high chair was conceived and is a prime example of the kind of furniture needed for this purpose. These high chairs are essentially a small chair mounted on longer than usual legs so that the child and high chair could be placed close to a table to enable the child to eat with adults.

The addition of a tray on the high chair made it possible to place the child in any convenient location at feeding time. Initially, the tray was a permanent part of the high chair, swinging over the child's head so that he or she might be placed on the seat.

The most common current style of infant high chair is of a folding design with metal tubular legs and a removable tray made of metal or plastic. This type of furniture is a fixture since using it requires floor space and transporting it is awkward since even in its folded state it is bulky and hard to handle.

Hook-on baby seats are known for fastening to the edge of a table, but have the deficiency of being a single purpose piece of furniture.

The alternative to the individual high chair and the individual hook-on baby seat is a dual purpose high chair and detachable baby seat which functions equally well as a high chair and as a separate hook-on baby seat.

The hook-on baby seat may be easily transported and serve its function without the need of transporting the leg structure of the high chair. Since not all tables will accept a clamping device on its edge, the attachment means of a hook-on baby seat for gripping the edge of the table must compensate for this limitation.

Accordingly, a need exists for a freestanding tabletop high chair, the infant seat of which may be readily detached and used as a hook-on baby seat independently of the legs of the high chair and then quickly reassembled as a high chair when so desired.

DESCRIPTION OF THE PRIOR ART

Although no single reference is known which discloses all of the claimed features of the dual purpose high chair and hook-on baby seat disclosed herein, the following patents are of interest:

U.S. Pat. No. 3,425,743 discloses a folding type high chair employing a back portion hingedly mounted on the seat portion and including a stop means adjustable to a selected position for determining the extent of rearward inclination of the chair back.

U.S. Pat. No. 3,649,074 discloses a baby seat and collapsible support frame. The baby seat, when not supported on the support frame, has a pivotal extension bar at the rear which increases the support base area for the seat. The seat is adjustable into a number of inclined positions.

U.S. Pat. No. 4,568,120 discloses a hook-on type baby seat having a forwardly projecting anchor member which is adapted to overlie a table and a pair of gripping members below said anchor members for gripping a bottom surface of a table. A latch extends between the gripping members and the back of the baby seat for latching the gripping members in position.

Application is unaware of any patents relating to the particular dual purpose high chair and hook-on baby seat obtained herein.

SUMMARY OF INVENTION

In accordance with the invention claimed, a dual purpose high chair is provided, the baby seat of which may be detached and used as a hook-on baby seat for fastening to the edge of a table.

It is, therefore, one object of this invention to provide a dual purpose high chair and hook-on baby seat.

Another object of this invention is to provide an improved combination high chair and hook-on baby seat having critically positioned points of pivoting, abutting contact surfaces, and points of clamping pressure to provide both a simplified structure and a very rigid folding high chair and hook-on baby seat arrangement.

A further object of this invention is to provide a dual purpose high chair, the seat of which may be readily detached to serve as a hook-on baby seat for gripping the edge of a table.

A still further object of this invention is to provide baby furniture in a form that is convertible to one of a number of forms so that its parts may be separately used.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
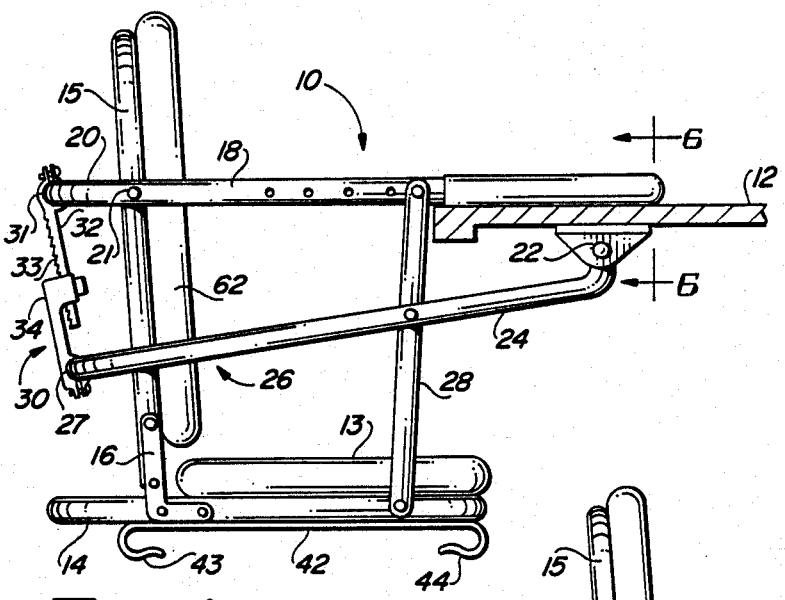
FIG. 1 is a side elevation view of a baby seat in accordance with the invention claimed for attaching to the edge of a tabletop.
Figure 3:
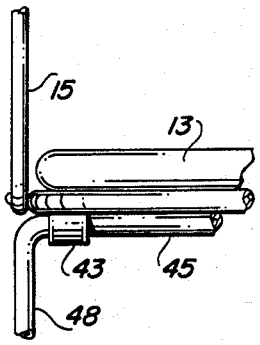
FIG. 3 is a cross-section view of FIG. 2 taken along the line 3—3.
Figure 2:
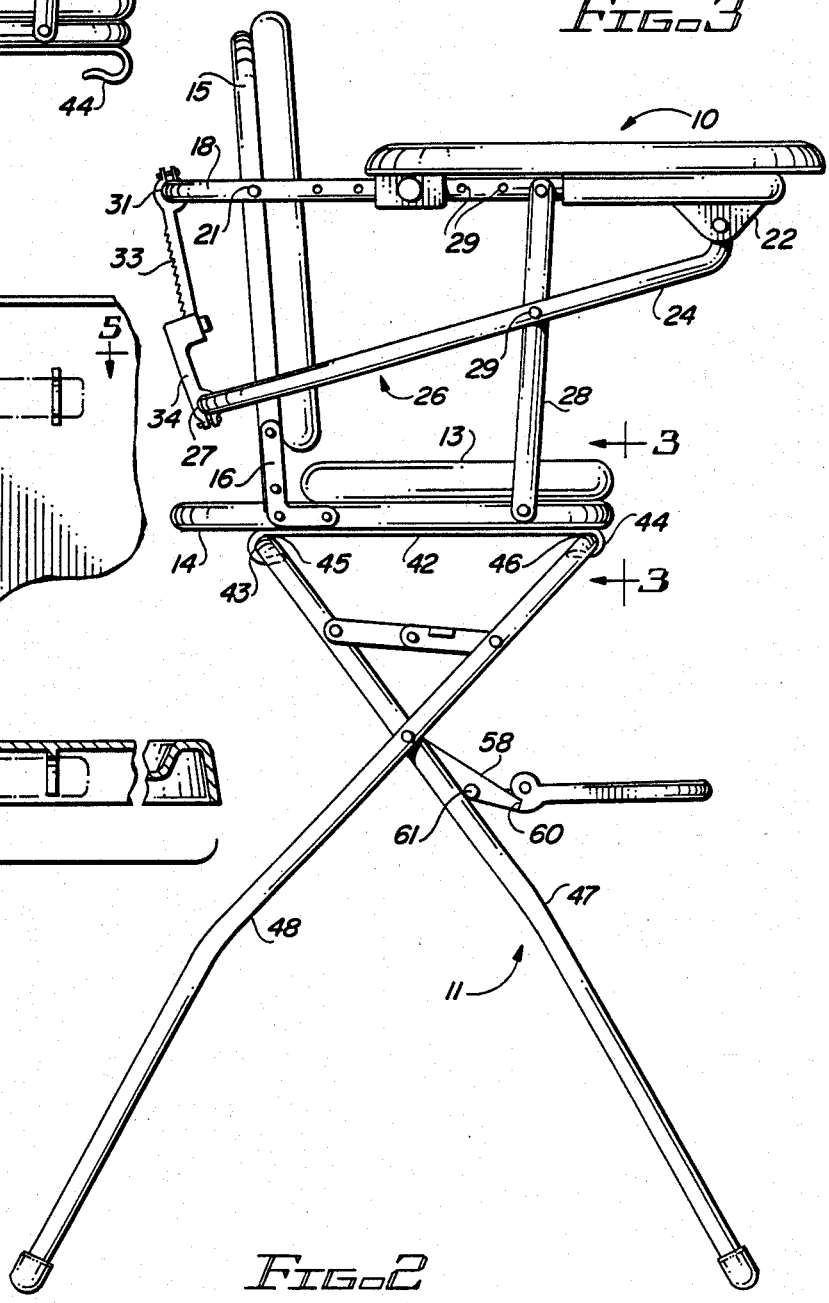
FIG. 2 is a side elevation view of a high chair embodying the hook-on baby seat disclosed in FIG. 1.

Referring more particularly to the drawings by characters of reference, FIG. 1 discloses a hook-on type baby seat 10 for detachably mounting on a tabletop 12 or on a collapsible leg structure 11 to form a high chair as shown in FIG. 2. The tabletop 12 may be a part of a kitchen or picnic table or of any other suitable flat structure such as a shelf or the like.

Baby seat 10 includes a seat portion 13 attached to a U-shaped frame 14. A back portion of the seat is formed by a U-shaped frame 15 with both frames 14 and 15 being formed preferably of noncorrosive hollow metal tubes which have been chrome plated. Each leg of frame 14 is connected to an adjacent leg of frame 15 by a bracket 16.

As shown in FIGS. 1 and 2, each bracket is L-shaped with the generally horizontal leg of bracket 16 being secured by fasteners to a leg of frame 14, and the generally vertical leg of bracket 16 being secured by fasteners to the leg of frame 15.

The baby seat further comprises a pair of anchor members 18 and 19 which overlie tabletop 12. Anchor members 18 and 19 constituting the free end portions of a U-shaped frame 20 for contacting the top surface of tabletop 11 and are preferably provided with a plastic or rubber sleeve around their free ends to prevent marring of the surface of the table. Each leg of frame 20 is secured to a juxtapositioned leg of frame 15 by a pin 21.

Below the elevation of anchor members 18 and 19 are provided a pair of gripping members 22 with each gripping member being generally an inverted U-shaped configuration having a plastic or rubber surface 23 on its bight forming its upper surface.

Gripping members 22 are pivotally connected to legs 24 and 25 of a U-shaped frame 26 with the legs being interconnected by a bight 27.

A link 28 has its upper end connected to one leg of frame 20, and its lower end connected to one leg of frame 14. Intermediate its ends, link 28 is pivotally connected to leg 24 of frame 26. A similar link is provided on the opposite side of baby seat 10 and is connected to frames 20, 14 and 26 in the same manner as described above with respect to link 28.

As shown in FIGS. 1 and 2, a latch means 30 extends between a bight 31 of frame 20 and bight 27 of frame 26. This latch means includes an elongated rack 32, which clamps on bight 31 of frame 20 at one end and is provided with a plurality of teeth 33 along one side of its length which rack selectively moves through an aperture in one end of a link 34. The other end of link 34 is clamped on bight 27 of frame 26 as shown in FIGS. 1 and 2.

Figure 6:
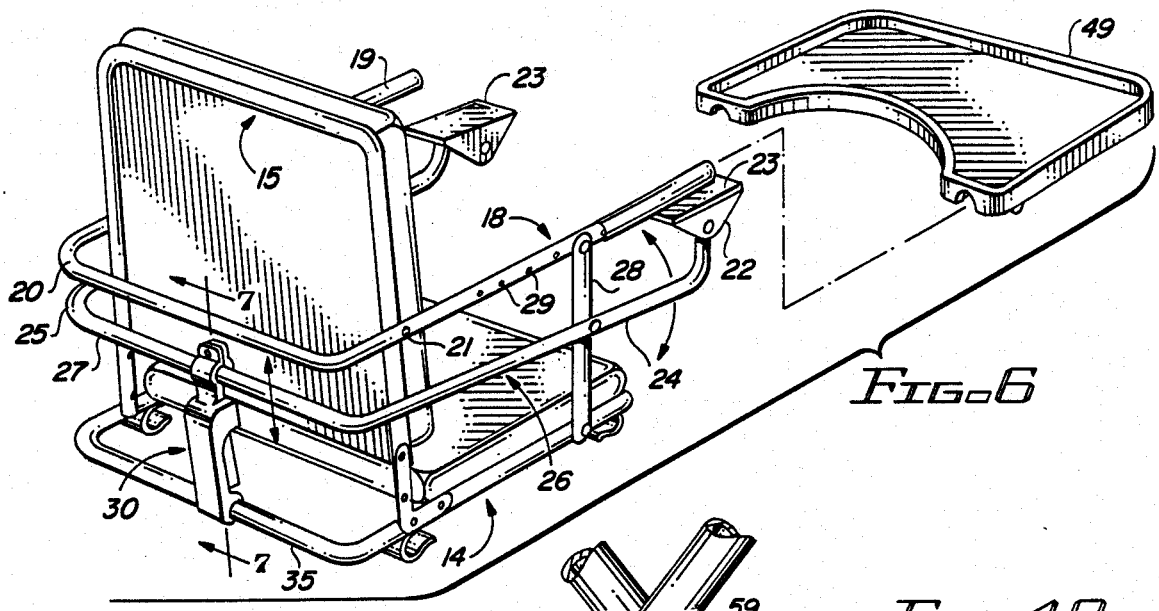
FIG. 6 is an exploded perspective view of a modification of the baby seat shown in FIG. 1.

It should be noted that latch means 30 may be alternately connected to extend between bight 27 of frame 26 and a bight 35 of frame 14, as shown in FIG. 6, and still fall within the scope of this invention.

Figure 7:
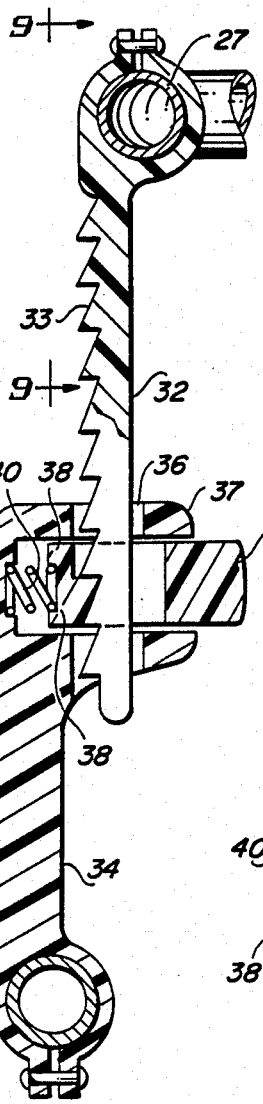
FIG. 7 is a cross-sectional view of FIG. 6 taken along the line 7—7.
Figure 9:
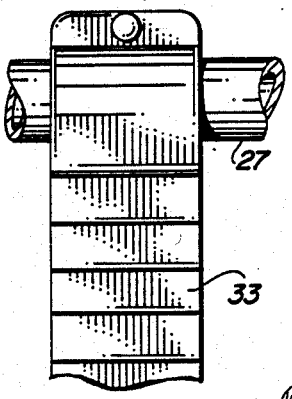
FIG. 9 is a view of FIG. 8 taken along the line 9—9.

As shown in more detail in FIG. 7, teeth 33 on rack 32 extend through an aperture 36 in a laterally extending arm 37 of link 34. A movable pawl 38 is mounted on link 34 to extend laterally through aperture 36 of arm 37. This pawl is spring biased into engagement with one of the teeth 33 on rack 32, and can be released from a given locking position with teeth 33 by finger pressure on knob 39 acting against the bias of spring 40. It will be noted that pawl 38 preferably has one or more teeth 41 in engagement with one or more teeth 33 on rack 32. Pawl 38 does not interfere with folding or collapsing of the baby seat when pressure is applied to knob 39 of pawl 38.

As shown in FIGS. 1, 2 and 6, the bottom of baby seat 10 is provided with a flat plate like clamp 42, the ends of which are turned over to face each other to form U-shaped channels 43 and 44. These channels are intended to grasp and particularly surround the bights 45 and 46 of U-shaped legs 47 and 48 of the leg structure of the high chair, as shown in FIG. 2.

As noted from FIGS. 1, 2 and 6, the ends of anchor members 18 and 19 are provided for telescopically receiving in a known manner a tray 49 for use when the baby seat 10 is mounted on leg structure 12. When the baby seat is used for mounting on the edge of a table, the tray may be removed as shown in FIG. 6.

Figure 4:
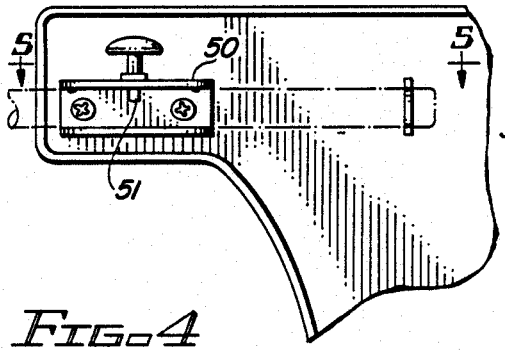
FIG. 4 is a partial view of the tray locking means shown in FIGS. 1 and 2.
Figure 5:
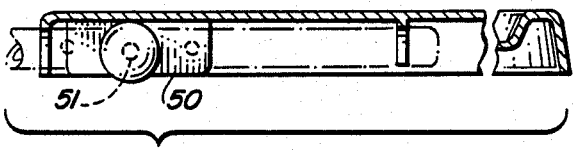
FIG. 5 is a cross-sectional view of FIG. 4 taken along the line 5—5.

FIGS. 4 and 5 illustrate a known way of detachably clamping tray 49 in one of a number of positions along anchor members 18 and 19 by means of spring biased releasable U-shaped clamps 50. These clamps each comprise a prong 51 which may be releasably inserted in one of the apertures 29 formed in anchor members 18 and 19 along its length. U-shaped clamp 50 is mounted on the bottom of tray 49 for receiving longitudinally therein anchor members 18 and 19. As noted, prong 51 extends through one of the legs of clamp 50 into one of the apertures 29 in anchor members 18 and 19.

FIGS. 2 and 10–13 disclose details of leg structure 12 of the high chair. As noted, the U-shaped legs 47 and 48 are pivotally connected together with one leg of each U-shaped structure being pivotally connected with one leg of the other U-shaped leg structure.

A footrest assembly 55 is mounted on the leg structure and comprises a platform 56 hingedly connected at 57 to a pair of support arms 58. Each support arm is pivotally connected to the pivotal connection 59 of legs 47 and 48 of the leg structure described above.

Figure 10:
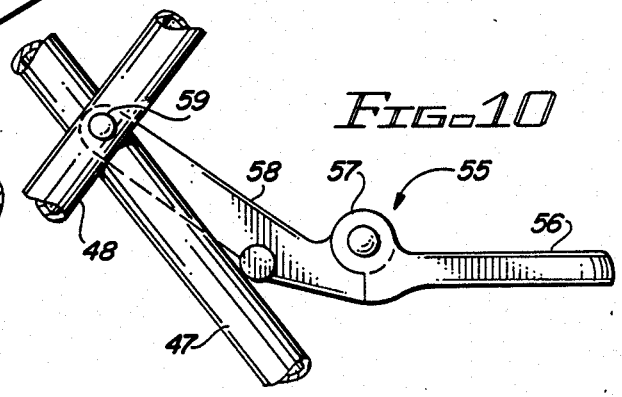
FIGS. 10–12 disclose partial views of the footrest of the high chair illustrating it in a number of positions.
Figure 11:
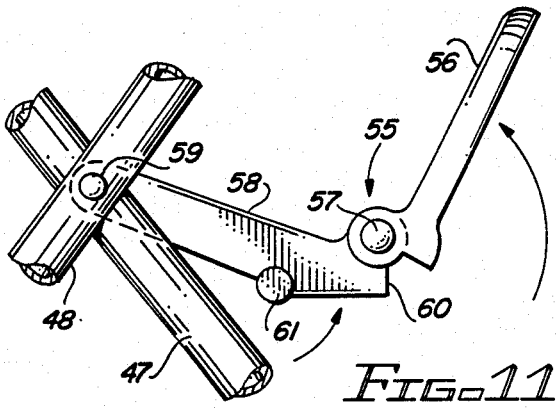
Figure 8:
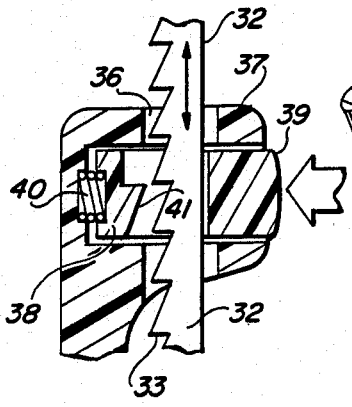
FIG. 8 is a partial view of the latch mechanism shown in FIG. 7 in a different position.
Figure 12:
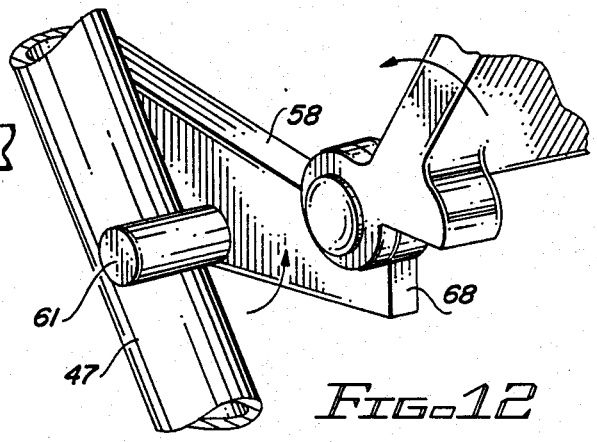

As shown in FIGS. 10–12, arm 58 is provided with a stop 60 for limiting its rotation movement in a clockwise direction with reference to arm 47 and arm 58 is provided with a stop 61 which engages leg 47 of the leg assembly and limits its clockwise movement relative to leg 47.

When baby seat 10 is separated from leg structure 12 by slipping the bights of U-shaped legs 47 and 48 out of ends 43 and 44 of clamp 42, it may be attached to tabletop 11 as follows:

Pressure is applied to knob 39 of pawl 38 to overcome the bias of spring 40, thereby disengaging teeth 33 from teeth 41 of the pawl structure. Bight 27 or 31 of U-shaped structures 20 or 26 is then pivoted upwardly to thereby provide a sufficient gap between the ends of anchor members 18 and 19 and gripping members 22 and 23 for positioning there between the edge of table top 11. The baby seat is then moved horizontally until anchor members 18 and 19 overlie the tabletop 11. Thereafter, the pressure on the bights of U-shaped structure 20 or 26 is released and a downward pressure is applied to bight 27 or 31 of U-shaped structures 20 or 26, with the simultaneous application of pressure on knob 39 of pawl 39 of latch means 30.

With the gripping members 22 and 23 tightly against the under side of tabletop 11, the pressure on knob 39 is released and a slight upward pressure is applied to bight 27 or 31 to move one or more of the teeth 33 of rack 32 downward into engagement with one or more of the teeth on pawl 38.

Baby seat 10 is now latched to tabletop 11 with sufficient gripping force. The back portion 62 of the baby seat and the seat portion 13 always remain in the same desired angular relationship, regardless of the thickness of the tabletop, since the portions of the baby seat remain in an operative position due to the relative movement of rack 32 and link 34 of latch means 30.

In order to release baby seat 10 from tabletop 11, it is only necessary to repeat the above steps in reverse order.

It should be noted that baby seat 10 may be collapsible by any suitable means such as the means shown in U.S. Pat. No. 4,568,120 which is included herein by reference. Thus, seat position 62 may be pivotally movable relative to seat position 13 and still fall within the scope of this invention.

Although but two embodiments of the invention have been illustrated and described, it will be apparent to those skilled in the art that various changes and modifications may be made therein without departing from the spirit of the invention or from the scope of the appended claims.

What is claimed is:

1. A duel purpose comprising:

a seat component a supporting leg structure said leg structure comprising a rearwardly extending U-shaped leg means, the bight of which is rotatively connected to and detachably attaching means on the front of said seat component and a forwardly extending U-shaped leg means pivotally connected to said rearwardly extending leg means beneath said seat component, the bight of which is rotatively connected to and detachably attaching means on the rear of said seat component, thereby forming a high chair, said seat component alternatively being detached from said supporting leg structure and independently useable for clamping on the edge of a table to form a hook-on baby seat, said seat component comprising a seat portion and a back portion coupled to a forwardly projecting anchor member which is adapted to overlie a tabletop or the like and a grip means having a pair of free ends below the elevation of said anchor member for gripping a bottom surface of the table or the like, means movably coupling said grip means being supported for movement toward and away from the elevation of said anchor member, and latch means extending between said grip means and said anchor member for latching the free ends of said grip means in one of a plurality of positions.

2. The folding high chair set forth in claim 1 wherein:

said latch means includes a rack having a set of teeth along an arcuate portion of the rack, said rack being attached to said anchor member, a pawl attached to said grip means for movement with said grip means, said pawl having teeth adapted to mesh with the teeth on said rack.

3. The folding high chair set forth in claim 2 wherein:

said pawl is spring biased in a position wherein said teeth on the pawl engage teeth on the rack.

4. The folding high chair set forth in claim 1 wherein:

said seat portion comprises a flat plate, the ends of which are turned over to face each other, and each form a channel constituting said attaching means opening toward the opposite end of said seat portion for each rotatably receiving the bight of a different one of said leg means.

5. The folding high chair set forth in claim 1 in further combination with:

a tray for telescopically detachably connecting to the end of said anchor member.

6. The folding high chair set forth in claim 1 wherein:

said anchor member comprises a U-shaped configuration having a pair of spaced legs and a bight with each leg attached to a different side of said back portion and their free ends extending outwardly of said seat portion for overlying a tabletop.

* * * * *

UNITED STATES PATENT AND TRADEMARK OFFICE

CERTIFICATE OF CORRECTION

PATENT NO. : 4,844,537

DATED : July 4, 1989

INVENTOR(S) : Peggy H. Reed

It is certified that error appears in the above-identified patent and that said Letters Patent is hereby corrected as shown below:

Claim 1, line 2, after "component" insert ---,---.

Claim 1, line 3, after "structure" insert ---,---.

Claim 1, line 6, after "tively" insert ---and detachably---.

Claim 1, line 6, after "to" delete "and detachably".

Claim 1, line 11, after "rotatively" insert ---and detachably---.

Claim 1, line 11, after "to" delete "and detachably".

Claim 1, line 24, after "means" second occurrance insert ---to said anchor member, said free ends of said grip means---.

Signed and Sealed this

Twelfth Day of June, 1990

*Attest:*

HARRY F. MANBECK, JR.

*Attesting Officer*

*Commissioner of Patents and Trademarks*